US006192689B1

(12) United States Patent
Feitelberg et al.

(10) Patent No.: US 6,192,689 B1
(45) Date of Patent: Feb. 27, 2001

(54) REDUCED EMISSIONS GAS TURBINE COMBUSTOR

(75) Inventors: Alan S. Feitelberg, Niskayuna, NY (US); Kevin Michael Elward, Simpsonville, SC (US); Robert Lee Hillis, Oneonta, NY (US); Milton Bradford Hilt, Sloansville, NY (US); John Francis Love, Slingerlands, NY (US); Roointon Erach Pavri, Schenectady, NY (US); Richard Benjamin Schiefer, Niskayuna, NY (US); Richard Arthur Symonds, Simpsonville, SC (US)

(73) Assignee: General Electric Company, Schnectady, NY (US)

( * ) Notice: Subject to any disclaimer, the term of this patent is extended or adjusted under 35 U.S.C. 154(b) by 0 days.

(21) Appl. No.: 09/040,978

(22) Filed: Mar. 18, 1998

(51) Int. Cl.[7] ..... F02C 3/00
(52) U.S. Cl. ..... 60/752
(58) Field of Search ..... 60/752

(56) References Cited

U.S. PATENT DOCUMENTS

| | | | | |
|---|---|---|---|---|
| 2,595,999 | | 5/1952 | Way et al. . | |
| 2,947,485 | | 8/1960 | Woodruff et al. . | |
| 3,792,581 | | 2/1974 | Handa . | |
| 4,205,524 | * | 6/1980 | Schirmer | 60/39.06 |
| 4,269,032 | | 5/1981 | Meginnis et al. . | |
| 4,671,069 | | 6/1987 | Sato et al. . | |
| 6,101,814 | * | 8/2000 | Hoke et al. | 60/752 |

FOREIGN PATENT DOCUMENTS

| | | |
|---|---|---|
| 1493144 | 8/1967 | (FR) . |
| 676473 | 2/1951 | (GB) . |
| 6017635 | 7/1983 | (JP) . |
| 289916 | 9/1988 | (JP) . |
| 8261468 | 3/1995 | (JP) . |
| 11071218 | 2/2000 | (JP) . |

OTHER PUBLICATIONS

Lefebvre, A., H., "Gas Turbine Combustion", Hemisphere, Washington, Fig. 1.6, 1983.*

* cited by examiner

*Primary Examiner*—Timothy S. Thorpe
*Assistant Examiner*—Ehud Gartenberg
(74) *Attorney, Agent, or Firm*—Patrick K. Patnode; Marvin Snyder

(57) ABSTRACT

An optimized combustor cooperating with a compressor in driving a gas turbine comprises a cylindrical outer combustor wall having an upstream fuel entry region and a downstream turbine entry region. An array of mixing holes are disposed about the periphery of the outer combustor wall adjacent to the fuel entry region so as to lower $No_x$ production therein. An array of dilution holes are medially disposed within the outer combustor wall to provide an entry for dilution air to the combustor.

3 Claims, 5 Drawing Sheets

REDUCED EMISSIONS GAS TURBINE COMBUSTOR

BACKGROUND OF THE INVENTION

The present invention relates generally to industrial turbine engines, and more specifically, to combustor therein.

Industrial power generation gas turbine engines include a compressor for compressing air that is mixed with fuel and ignited in a combustor for generating combustion gases. The combustion gases flow to a turbine that extracts energy for driving a shaft to power the compressor and produces output power for powering an electrical generator, for example. The turbine is typically operated for extended periods of time at a relatively high base load for powering the generator to produce electrical power to a utility grid, for example.

Over the past ten years there has been a dramatic increase in the regulatory requirements for low emissions from turbine power plants. Environmental agencies throughout the world are now requiring low rates of emissions of NOx, CO and other pollutants from both new and existing turbines.

Traditional turbine combustor use non-premixed diffusion flames where fuel and air freely enter the combustion chamber separately and mixing of the fuel and air occurs simultaneously with combustion. Typical diffusion flames are dominated by regions that burn at or near stoichiometric conditions. The resulting flame temperatures can exceed 3000° F. (1650° C.). Because diatomic nitrogen reacts rapidly with oxygen at temperatures exceeding about 2850° F. (1565° C.), diffusion flames typically produce relatively high levels of NOx emissions.

One method commonly used to reduce peak temperatures, and thereby reduce NOx emissions, is to inject water or steam into the combustor. Water or steam injection, however, is a relatively expensive technique and can cause the undesirable side effect of quenching carbon monoxide (CO) burnout reactions. Additionally, water or steam injection methods are limited in their ability to reach the extremely low levels of pollutants now required in many localities. Furthermore, this approach cannot be used in installations where water or steam is not available, for example, remote pipeline stations Due to these limitations of traditional diffusion flame combustor, lean premixed gas turbine combustor were developed. Lean premixed combustors can achieve very low NOx and CO emissions without diluent injection. Lean premixed combustors mix the fuel and the air prior to combustion thus eliminating the high temperature conditions which lead to NOx formation. This reduction in emissions, however, is achieved at the expense of simplicity and cost. Premix combustors can cost five to ten times more than traditional diffusion flame combustors, as premix combustors frequently include multiple fuel injectors or fuel nozzles, as well as multiple fuel manifolds, multiple purge manifolds, and multiple fuel control valves. Furthermore, premix combustors typically have multiple modes of operation. Lean premixed combustors can operate in a premixed mode and achieve the low emissions of premix combustion only over a narrow load range, typically near base load. At reduced loads, however, premix combustors must often be operated as diffusion flame combustors, due to flammability limits. This need for mode switching adds cost and complexity to the combustion system.

Therefore, it is apparent from the above that their exists a need in the art for an improved gas turbine combustor that combines the low-cost and simplicity of operation of a diffusion flame combustor and the reduced emissions of a premixed combustor.

SUMMARY OF THE INVENTION

An optimized combustor cooperating with a compressor in driving a gas turbine comprises a cylindrical combustor wall having an upstream fuel entry end and a downstream turbine entry end. An array of mixing holes are in the combustor wall adjacent to the fuel entry region so as to lower $NO_x$ production therein. An array of dilution holes are medially disposed in the combustor wall to provide an entry for dilution air to the combustor.

DETAILED DESCRIPTION OF THE INVENTION

Figure 1:
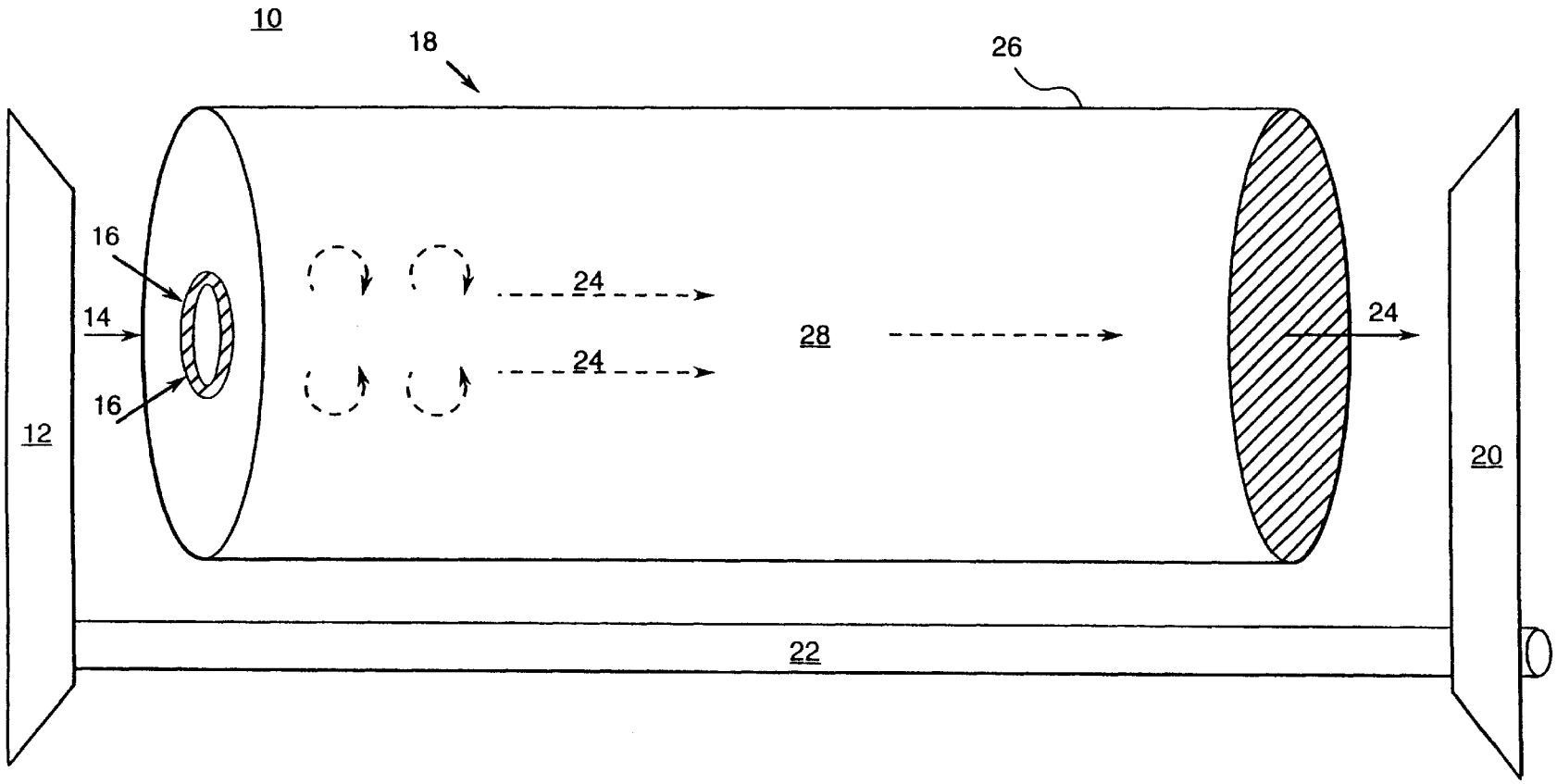
FIG. 1 is a schematic representation of a portion of an industrial gas turbine engine having a low NOx combustor in accordance with one embodiment of the present invention joined in flow communication with a compressor and turbine.

An exemplary industrial power generation gas turbine engine 10 includes a compressor 12 for compressing air 14 that is mixed with fuel 16 and ignited in at least one combustor 18, as shown in FIG. 1. A turbine 20 is coupled to compressor 12 by a drive shaft 22, a portion of which drive shaft 22 extends for powering an electrical generator (not shown) for generating electrical power. During operation, compressor 12 discharges compressed air 14 that is mixed with fuel 16 and ignited for generating combustion gases 24 from which energy is extracted by turbine 20 for rotating shaft 22 to power compressor 12, as well as for producing output power for driving the generator or other external load. Combustor 18 comprises a cylindrical combustor wall 26 defining a combustion chamber 28 therein.

Figure 2:
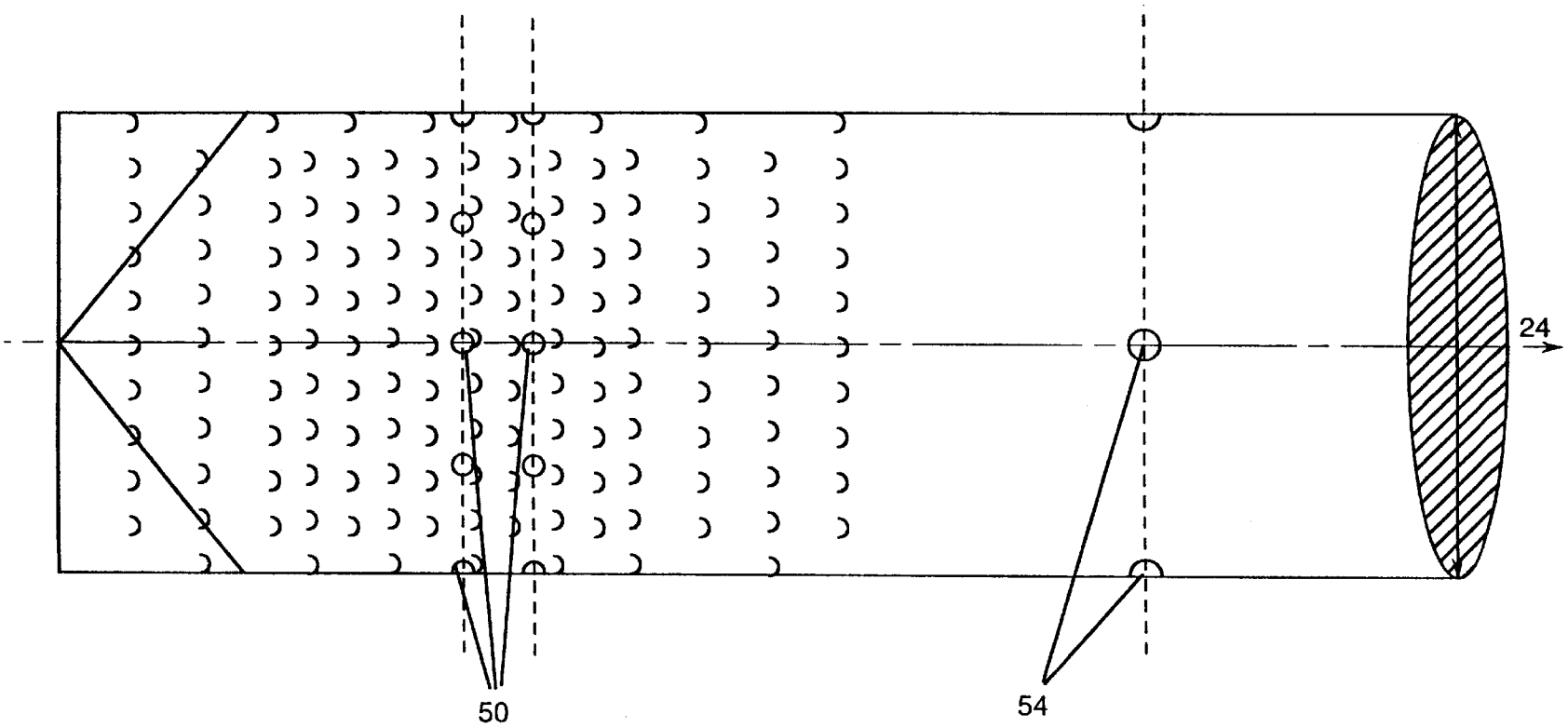
FIG. 2 is a side elevational view of a prior art combustor.

Typically, conventional combustors comprise several sets of primary air holes disposed about the periphery of the combustor, as shown in FIG. 2. A first set of air holes 50, referred to as mixing holes, supply a quantity of air to the reaction zone within combustion chamber 28. First set of air holes 50 are disposed in the central region of most conventional combustors. A second set of air holes 54 are positioned at the downstream end of the combustion chamber to quench combustion gases 24 prior to entering a transition piece (not shown) or a turbine inlet (not shown).

When conventional combustors were originally designed, little attention was given to the resulting NOx emissions. The original design objectives were typically; achieving complete combustion; having a reasonable pressure drop; long part life (low metal temperatures); good flame stability, turn down, and ignition characteristics; and a desired exhaust temperature profile. Once these objectives were attained, the design effort was complete. As a consequence, conventional combustors produce relatively high NOx emissions.

Figure 3:
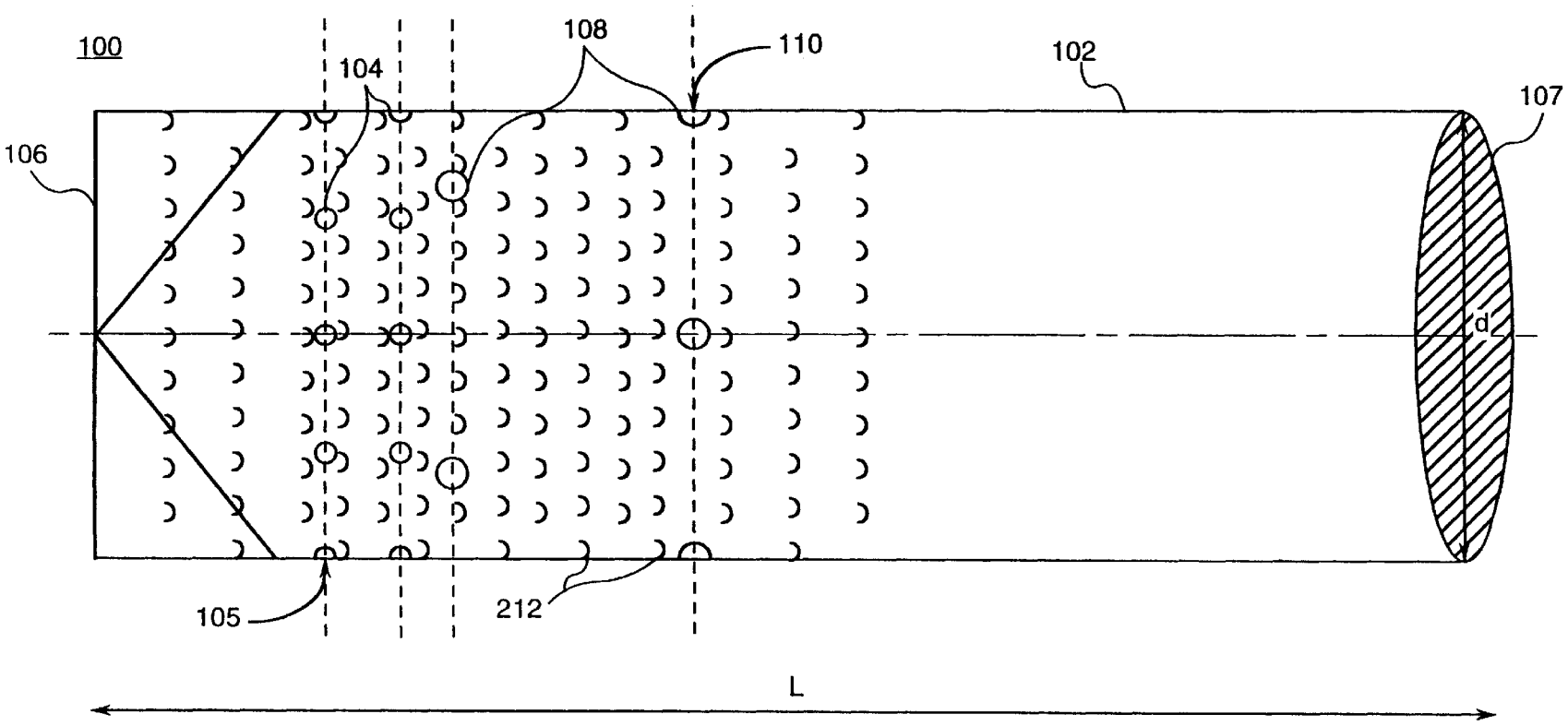
FIG. 3 is a side elevational view of a combustor in accordance with one embodiment of the instant invention.

In accordance with one embodiment of the instant invention, an optimized combustor 100 is shown in FIG. 3.

Combustor 100 comprises a cylindrical combustor wall 102 having a fuel entry end 106 and a turbine entry end 107. Combustor wall 102 typically has a nominal diameter (d) in the range between about 9 inches to about 15 inches and a nominal length (L) in the range between about 35 inches to about 50 inches. Combustor wall 102 may be fabricated out of any conventional combustion liner materials including but not limited to Hastelloy X and the like.

In one embodiment of the instant invention, a plurality of mixing holes 104 are disposed proximate to fuel entry end 106 of combustor 100 to provide an entry for mixing air 105. Typically, mixing holes 104 have a diameter in the range between about 0.5 inches to about 1 inch. The number of mixing holes 104 is variable typically depending on the overall size of combustor 100. In one embodiment of the instant invention, the number of mixing holes 104 is in the range between about 5 to about 20 holes.

Typically mixing holes 104 are axially disposed between about 3 inches to about 10 inches from fuel entry end 106. Furthermore, mixing holes 104 typically, although not necessarily, are equally circumferentially distributed about combustor wall 102. In one embodiment of the instant invention, mixing holes 104 are positioned about the circumference of combustor wall 102 in at least two axially spaced rows of holes to axially space mixing air 105 entering combustor 100. By introducing a larger fraction of mixing air 105 into combustor 100 at or near fuel entry end 106, the fuel-air mixing characteristics are improved. This introduction of a larger fraction of air reduces the amount of combustion that takes place at stoichiometric conditions, and accordingly reduces $NO_x$ emission.

Combustor 100 further comprises a plurality of dilution holes 108 disposed within combustor wall 102 to provide an entry area for dilution air 110 to combustor 100. Dilution air 110 is provided to lower the temperature of combustion gases 24 prior to entering a turbine inlet (not shown) or a transition piece (not shown). Typically, dilution holes 108 have a diameter in the range between about 1.25 inches to about 3.0 inches. The number of dilution holes 108 is variable typically depending on the overall size of combustor 100. In one embodiment of the instant invention, the number of dilution holes 108 is in the range between about 4 to about 12 holes.

Typically dilution holes 108 are axially disposed between about 5 inches to about 20 inches from fuel entry end 106.

By introducing a larger fraction of dilution air 110 into combustor 100 closer to fuel entry end 106, the carbon monoxide burnoff period of combustor 100 is shortened. This shortened period of CO burnoff produces higher CO levels. The production of higher CO levels within combustor 100 is offset by the low-level NOx production. Accordingly, this non-obvious combination of axially shifted air holes results in an optimized combustor having greatly improved NOx production levels with increased levels of CO production.

By axially shifting mixing holes 104 and dilution holes 108 towards fuel entry end 106 of combustor 100 (in contrast to prior art combustor, see FIG. 2), an optimized design for a combustor is achieved. Furthermore, an optimized design for a diffusion flame, non-premixed combustor is achieved while maintaining: complete combustion; a reasonable pressure drop; long part life; good flame stability, turn down and ignition characteristics; and a desired exhaust temperature profile.

In accordance with another embodiment of the instant invention, combustor 100 further comprises a plurality of louvers 112. In one embodiment, combustor 100 comprises 17 rows of 32 louvers 112 equally distributed about the circumference of combustor wall 102. In one embodiment of the instant invention, combustor 100 has an overall length (L) of 43.80 inches and with respect to fuel entry end 106, rows having 32 louvers 112 each are positioned at the following axial locations: 3.12 inches; 4.12 inches; 5.12 inches; 5.27 inches; 6.62 inches; 7.37 inches; 8.12 inches; 8.87 inches; 9.62 inches; 11.12 inches; 12.62 inches; 14.37 inches; 16.12 inches; 17.87 inches; 20.37 inches; 22.87 inches; and 25.37 inches.

Figure 4:
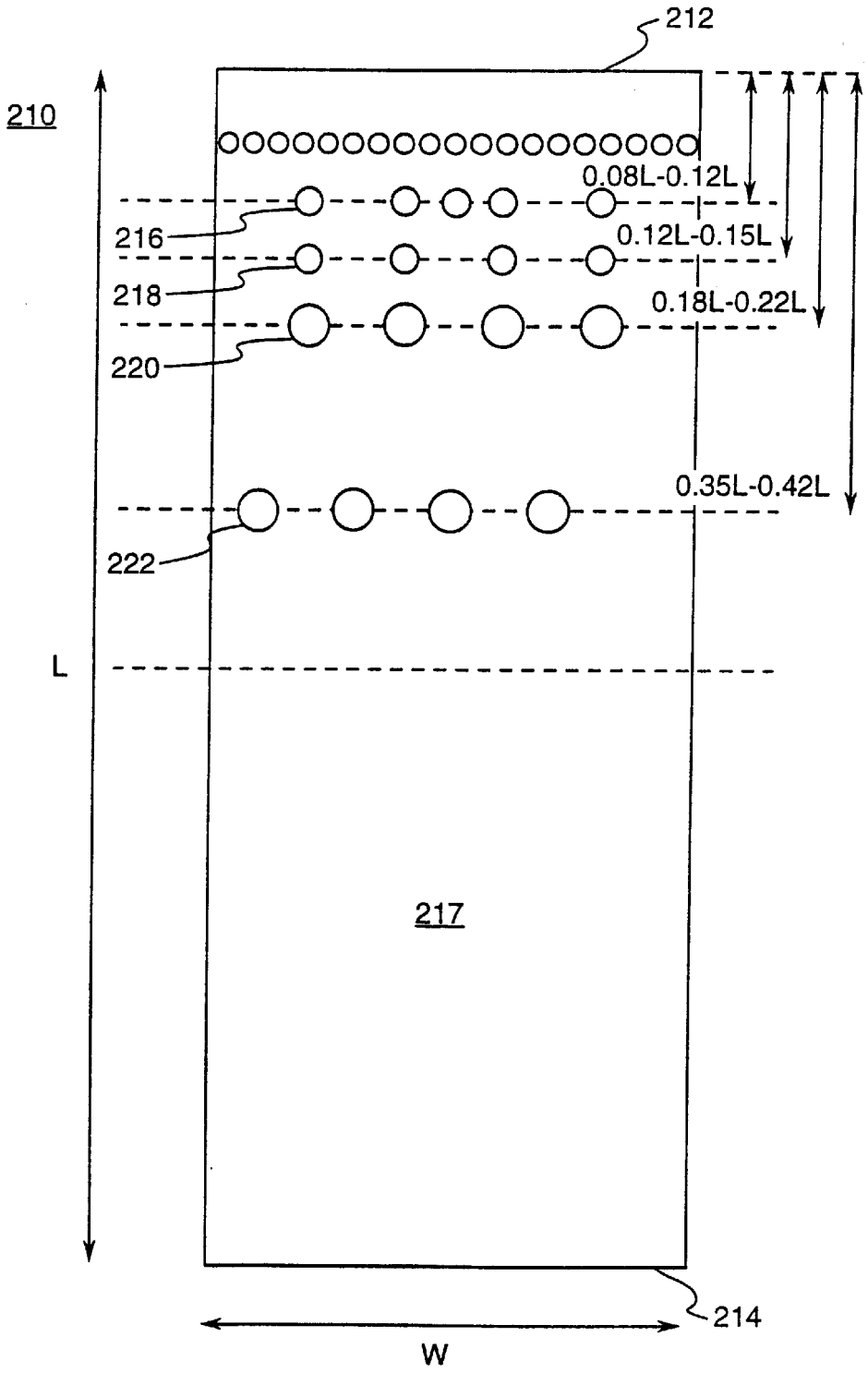
FIG. 4 is an elevational view of a combustor cutout in accordance with one embodiment of the instant invention.

In one embodiment of the instant invention, a combustor 210 comprises the following design as shown in FIG. 4. In this embodiment, combustor 210 is shown as a machined piece having a top 212 and a bottom 214 prior to being cold rolled. Combustor 210 has a nominal length (L) of about 46 inches and a nominal width (w) of about 34 inches.

A first plurality of mixing holes 216 are axially positioned at about 4.6 inches from top 212. The number of first plurality of mixing holes 216 varies depending on the overall size of combustor 210. In one embodiment, the number of first plurality of mixing holes 216 is about five. First plurality of mixing holes 216 have a nominal diameter of about 0.875 inches A second plurality of mixing holes 218 are axially positioned at about 6.6 inches from top 212. The number of second plurality of mixing holes 218 varies depending on the overall size of combustor 210. In one embodiment, the number of second plurality of mixing holes 218 is about 4. Second plurality of mixing holes 218 have a nominal diameter of about 0.76 inches.

A first plurality of dilution holes 220 are axially positioned at about 9 inches from top 212. The number of first plurality of dilution holes 220 varies depending on the overall size of combustor 210. In one embodiment, the number of first plurality of dilution holes 220 is about 4. First plurality of dilution holes 220 have a nominal diameter of about 1.75 inches.

A second plurality of dilution holes 222 are axially positioned at about 17.85 inches from top 212. The number of second plurality of dilution holes 222 varies depending on the overall size of combustor 210. In one embodiment, the number of second plurality of dilution holes 222 is about 4. Second plurality of dilution holes 222 have a nominal diameter of about 1.75 inches.

One embodiment of an optimized combustor configuration can be utilized with all sizes of combustors using the following basic design criteria, as depicted in FIG. 4. (See Table 1)

Each combustor has a fuel entry end 212 and a turbine entry end 214 and an overall length (L). First plurality of mixing holes 216 are disposed in combustor wall 217 and are axially positioned in a range between about 0.08 L to about 0.12 L from fuel entry end 212.

Second plurality of mixing holes 218 are disposed in combustor wall 217 and are axially positioned in a range between about 0.12 L to about 0.15 L from fuel entry end 212.

First plurality of dilution holes 220 are disposed in combustor wall 217 and are axially positioned in a range between about 0.18 L to about 0.22 L from fuel entry end 212.

Second plurality of dilution holes 222 are disposed in combustor wall 217 and are axially positioned in a range between about 0.35 L to about 0.42 L from fuel entry end 212.

TABLE 1

| Total Length | 1st mixing holes axial positon | Relative to L | 2nd mixing holes axial position | Relative to L | 1st dilution holes axial position | Relative to L | 2nd dilution holes axial position | Relative to L |
|---|---|---|---|---|---|---|---|---|
| 45.98 in | 4.62 in | 0.1 L | 6.46 in | 0.14 L | 8.625 in | 0.188 L | 17.875 in | 0.389 L |
| 43.80 in | 4.62 in | 0.105 L | 6.465 in | 0.147 L | 8.62 in | 0.197 L | 17.86 in | 0.41 L |
| 43.80 in | 4.78 in | 0.11 L | 6.465 in | 0.147 L | 8.62 in | 0.197 L | 17.86 | 0.41 L |

Figure 5:
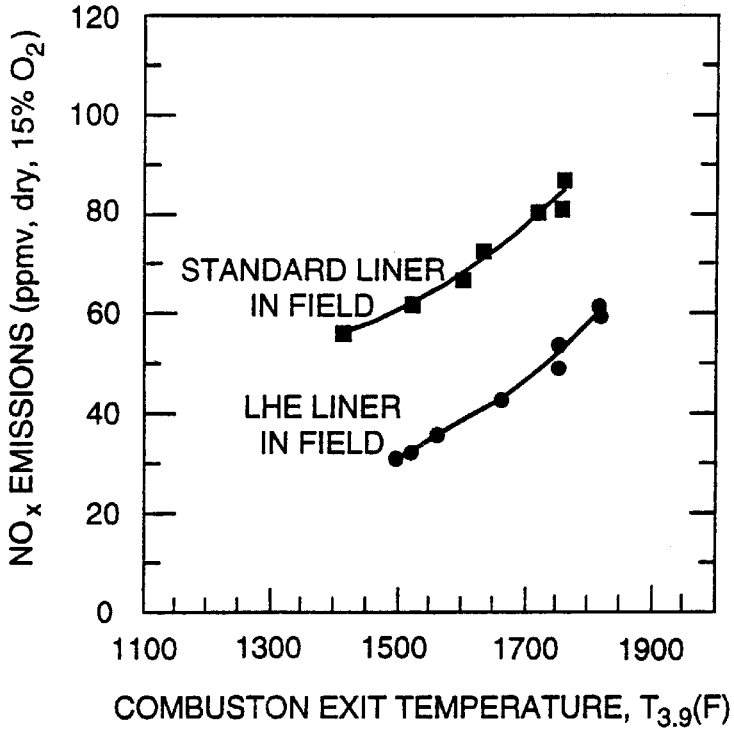
FIG. 5 is a graphical comparison of NOx levels.

A comparison of NOx emissions from a standard combustor and an optimized combustor in accordance with one embodiment of the instant invention is shown in FIG. 5. As shown in FIG. 5, depending upon load, NOx emissions levels within the optimized combustor were 40% to 50% less than those of the standard combustor.

Figure 6:
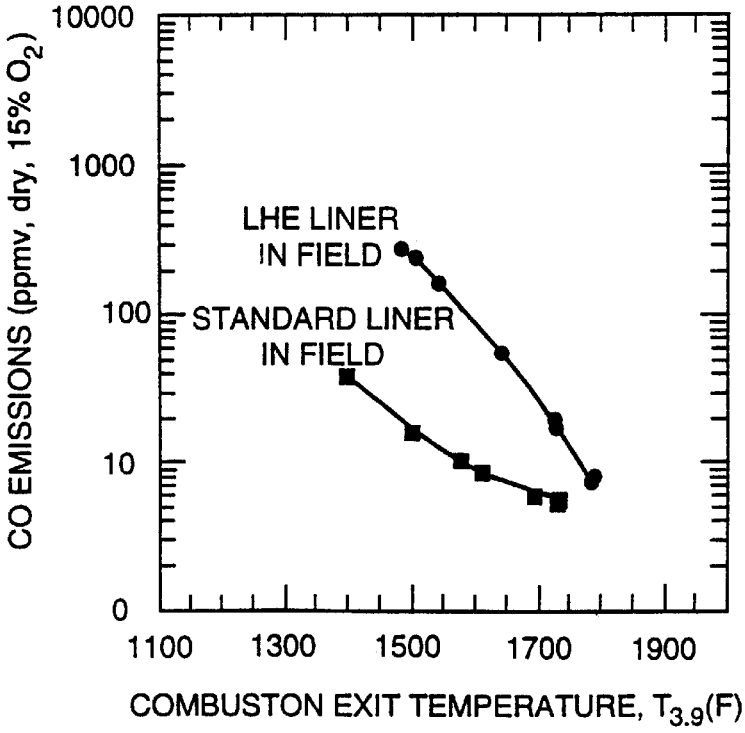
FIG. 6 is a graphical comparison of CO levels.

The comparison of CO emissions from a standard combustor and an optimized combustor is shown in FIG. 6. As shown in FIG. 6, depending upon load, CO emissions were increased within the optimized combustor in comparison to the standard combustor design, as discussed above.

While only certain features of the invention have been illustrated and described, many modifications and changes will occur to those skilled in the art. It is, therefore, to be understood that the appended claims are intended to cover all such modifications and changes as fall within the true spirit of the invention.

What is claimed is:

1. An optimized combustor cooperating with a compressor in driving a gas turbine, said combustor comprising:

a cylindrical outer combustor wall having an upstream fuel entry end, a downstream turbine entry end and a length in the range between about 35 inches to about 50 inches;

an array of mixing holes having a diameter in the range between about 0.5 inches to about 1.0 in. axially disposed between about 3 inches to about 10 inches from said fuel entry end so as a lower NOx production therein; and an array of dilution holes having a diameter in the range between about 1.25 inches to about 3.0 inches axially disposed between about 5 inches to about 20 inches from said fuel entry end.

2. An optimized combustor in accordance with claim 1, wherein the number of mixing holes is in the range between about 5 to about 20 holes.

3. An optimized combustor in accordance with claim 1, wherein the number of dilution holes is in the range between about 4 to about 12 holes.

* * * * *